US005179897A

United States Patent [19]

Liebregts

[11] Patent Number: 5,179,897

[45] Date of Patent: Jan. 19, 1993

[54] PATTERN REPEAT PRESETTING OF A MULTI-COLOR ROTARY SCREEN PRINTING MACHINE

[75] Inventor: Paulus M. M. Liebregts, Veldhoven, Netherlands

[73] Assignee: Stork Brabant B.V., An Boxmeer, Netherlands

[21] Appl. No.: 597,312

[22] Filed: Oct. 15, 1990

[30] Foreign Application Priority Data

Oct. 20, 1989 [NL] Netherlands ..... 8902600

[51] Int. Cl.[5] ..... B41M 1/12

[52] U.S. Cl. ..... 101/129; 101/115; 101/DIG. 36; 101/116; 33/620; 33/621

[58] Field of Search ..... 101/116-120, 101/127.1, 128, 128.1, DIG. 36, 115, 129; 33/614-621

[56] References Cited

U.S. PATENT DOCUMENTS 3,974,766 8/1976 Zimmer ..... 101/129
3,998,156 12/1976 Zimmer ..... 101/115
4,033,259 7/1977 Schuhmann ..... 33/618 X
4,164,184 8/1979 Vertegaal ..... 101/128.1 X
4,366,542 12/1982 Anselrode ..... 101/116 X
4,485,447 11/1984 Ericsson ..... 101/DIG. 36 X
4,872,407 10/1989 Banke ..... 33/617 X

FOREIGN PATENT DOCUMENTS 0311729 4/1989 European Pat. Off. .

*Primary Examiner*—Edgar S. Burr
*Assistant Examiner*—Christopher A. Bennett
*Attorney, Agent, or Firm*—Kenyon and Kenyon

[57] ABSTRACT

Described is a method for pattern repeat presetting of a multi color screen printing machine wherein the screen printing stencils to be used are pre-set on the basis of independently determined stencil-data and printing position data by establishing a fixed predetermined relation between these data. Also described is a multi color screen printing device having means for setting the lengthwise, widthwise and diagonal pattern repeat with use of a computer and independently determined printing position and stencil data. The invention also relates to a device of determining stencil data.

5 Claims, 4 Drawing Sheets

PATTERN REPEAT PRESETTING OF A MULTI-COLOR ROTARY SCREEN PRINTING MACHINE

BACKGROUND OF THE INVENTION

The invention relates to a method for the pattern repeat presetting of a rotary screen printing machine.

Such a method is known from the published Dutch patent application NL 7906131.

Pattern repeat presetting is important in order to limit loss of material when regulating the machine.

In a multi-colour rotary screen printing machine such as that used, for example, for printing textiles, the colours are printed in succession on a web by means of patterned cylindrical stencils. It is important here that the various colours should be placed in a good position relative to each other on the web. If a new pattern has to be printed, the cylindrical stencils will have to be placed as well as possible in the correct orientation in the machine, following which printing begins. An operator will visually assess the printed result and adjust the machine further in order to achieve the optimum printed result. The setting takes place, inter alia, through varying the orientation of a stencil relative to the other stencils. The latter is the so-called lengthwise pattern repeat setting. Widthwise and diagonal pattern repeat setting can also be carried out.

The earlier mentioned application 7906131 describes a method whereby, for a particular pattern, the setting of the rotary screen printing machine by which a suitable printed result is obtained is saved in a data file. The advantage of this is that when a particular pattern is being reprinted, if the stencils are replaced in the earlier used printing positions, optimum pattern repeat presetting can be achieved by recovering the data saved in the data file and with said data giving the machine the correct pre-setting. Initial losses are greatly reduced as a result.

The disadvantage of this method is that it does not provide any solution for the pattern repeat presetting of a pattern which is to be printed for the first time.

In addition it happens in practice that for a reprint the stencils required for a reprint are placed in the rotary screen printing machine in a different way from that for the first print. Part of the reason for this is the positioning of squeegee and colour feed systems in the printing operation prior to the reprinting. It is then sometimes more practical not to lose unnecessary machine operation time for moving these systems, something which results in great initial losses of material as a result of the re-setting of the machine.

Another reason for placing the stencils in a different order in the machine can be the desire to obtain a different colour scheme. This is obtained by using the same colours for a pattern, but changing the colours of the pattern parts.

Yet another reason for not replacing the stencils in the earlier used printing positions for a reprint can be that in the case of machines which have more printing positions than the number of colours which are being printed the printing positions not used are already prepared for the next printing operation, in order to reduce standstill losses.

The result of this is that the pattern repeat presetting data obtained earlier and saved can no longer be used because the data relate to the advance pattern repeat setting of stencils which are each placed in a specific printing position.

The techniques for patterning cylindrical stencils are being optimized to an increasing extent, so that increasingly more complex patterns with high resolution can be achieved. In addition, there is a demand from the market for patterns with more and more colours (twenty or more), often with the demand for exclusivity. This last demand means that the yardages of printed fabric are becoming smaller, so that the initial losses are relatively high.

SUMMARY OF THE INVENTION

In order to avoid the above-mentioned disadvantages the present method according to the invention is characterized in that the pattern repeat presetting is achieved on the basis of independently determined stencil data and printing position data, for each printing position a fixed predetermined relation between the stencil data and the printing position data being set.

Through this method a division is made between stencil data and data related to the printing position, the latter data having no relation to the stencil to be placed in the printing position.

It will be clear that the stencil data can be determined while the stencil is outside the printing machine; this implies that machine down-time due to presetting activities is avoided.

By means of this method stencils can be distributed over the printing positions in an arbitrarily selected manner, while a good pattern repeat presetting can still be achieved.

In addition, it is also possible to obtain a good pattern repeat presetting for patterns which are being printed for the first time. The data of the printing positions are in fact not related to the pattern, while the stencil data can be obtained very accurately by known measuring techniques (distance and/or angle measurement). The latter data need not be obtained from a printed result.

The method by which the stencil and the printing position data are determined is the subject of the subclaims.

The invention also relates to a device for multi-colour rotary screen printing according to the preamble of claim 4; such a device according to the invention has the aspects described in the characterizing part of claim 4.

Finally, the invention relates to a device for establishing the stencil data by measurement. The latter device is characterized by clamping means for the stencils mounted in end rings, which can accommodate the stencil and in which the angular orientation of the stencil can be varied, and means are present for the well-defined connection of the end ring reference point to an angular orientation measuring device, while provision is also made for a device for observing the stencil reference points, which device is fitted in a sliding manner on a measuring rod which runs mainly parallel to the axis of rotation of the stencil, and the measuring rod is provided with means for measuring the position of the observation device along the measuring rod.

In another embodiment the stencil can be fixed, and the observation device can, for example, be fitted so that it slides either along the measuring rod or in a direction mainly at right angles to the measuring rod.

BRIEF DESCRIPTION OF THE DRAWINGS

The invention will now be explained with reference to the drawing, in which.

Figure 1:
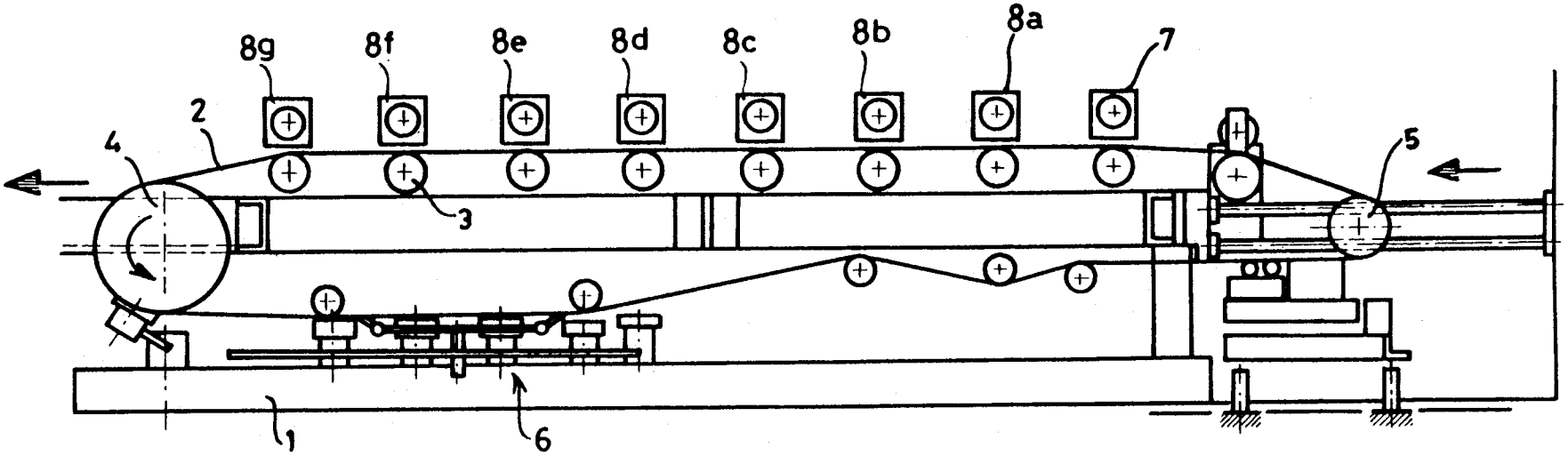
FIG. 1 shows a schematic representation of a multi-colour rotary screen printing machine.

A multi-colour rotary screen printing machine comprises a frame 1, as shown in FIG. 1. The frame contains rollers 4 and 5 over which an endless belt 2 is guided. A web can be stuck or otherwise placed temporarily on the belt 2 by means of a belt adhesive application device 6 or the like. The web is fed into the machine in the direction of the arrow on the right in FIG. 1, and is removed from the belt at the left. Printing positions 7 and 8, *a* to *g*, are also placed in the machine. A printing position can accommodate a cylindrical stencil provided with end rings at both ends and set it in rotation in such a way that the peripheral speed of the stencil is essentially equal to the belt speed. Colour is fed to the inside of the stencil by means of a colour feed system, and colour is pressed through the open part of the stencil by means of a squeegee system also fitted on the inside of the stencil, and the entire width thereof. The stencil is brought into intimate contact with the web placed on the belt, partly through the pressing action of the rollers 3, so that the colour is pressed onto the web. An operator can see the printed result from the printing position 8*a* and take regulating action by adjusting the relevant printing position.

The printing position 7 can be regarded here as the reference printing position, although in principle any other printing position can be used as the reference printing position.

Figure 2B:
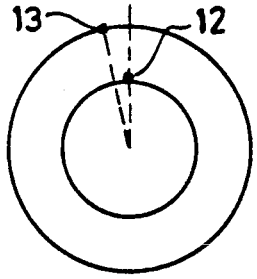
FIGS. 2*a* and 2*b* represent a schematic illustration of a cylindrical stencil mounted in end rings.
Figure 2A:
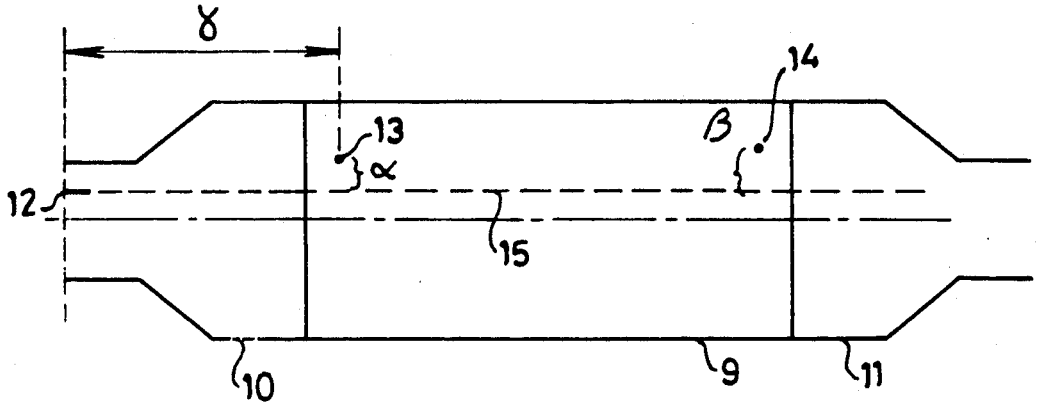

FIGS. 2*a* and 2*b* give an example of the reference points which can be used. A cylindrical stencil 9 is provided with two end rings 10 and 11.

A lobe 12, which serves as an end ring reference point, is provided on one of the end rings. It is possible by means of this lobe to place a cylindrical stencil provided with end rings in a well-defined position in a printing position. The angular orientation of the stencil in the printing position can be measured with a sensor and read electronically by a processing unit if desired. This lobe also, as it were, brings about the relation between the stencil and printing position data.

The angle relation between the end ring reference point 12 and the two stencil reference points 13 and 14 can be predetermined by means of known techniques. The stencil value gamma ($\gamma$) (see FIG. 2) can also be determined by distance measurement.

If the positioning of the end rings relative to the stencil takes place in such a way that the stencil reference points are approximately on one line 15, which line runs through the lobe 12 and is parallel to the axis of the stencil, then the angle relation can be determined by a distance measurement (namely measuring the distances alpha ($\alpha$) and beta ($\beta$) (see FIG. 2).

Figure 3:
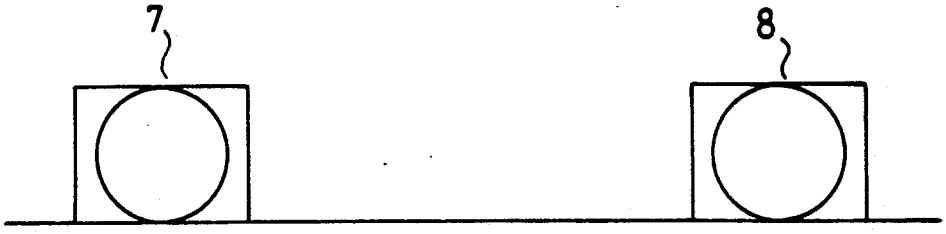
FIG. 3 shows a schematic view of the reference printing position and another printing position.

FIG. 3 shows schematically a reference printing position 7 and a second printing position 8.

Data concerning the printing position 8 can be generated by placing test stencils in positions 7 and 8.

A test stencil is, for example, a stencil which is provided with two crosses as stencil reference points, preferably fitted near the two ends of the stencil and in such a way that $\alpha=\beta$, and where the two stencils have the same $\alpha$ and $\gamma$ values.

Figure 4:
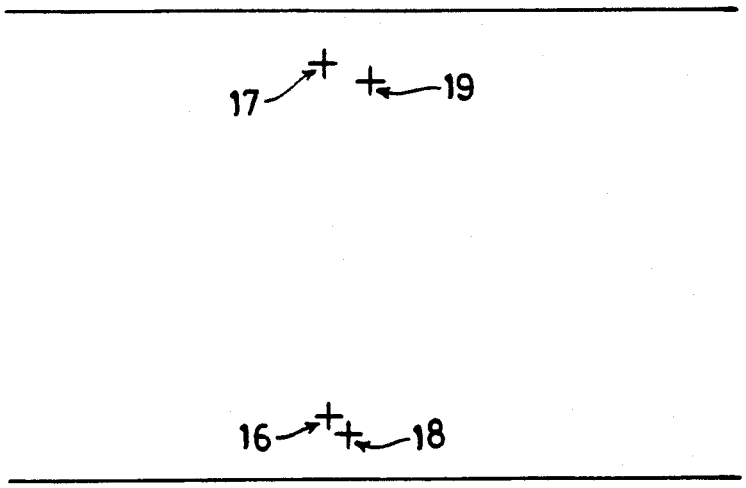
FIG. 4 shows a schematic view of a web printed with a standard stencil.

If the machine is made to print a web, then the printed result will be as shown in FIG. 4.

The deviations between the position of the crosses 16 and 18 and that of 17 and 19 are a measure of the correction which has to be made to the printing position 8 in order to make the crosses coincide.

These corrections can be derived from the relative position of the crosses through measurement and calculation.

Figure 5:
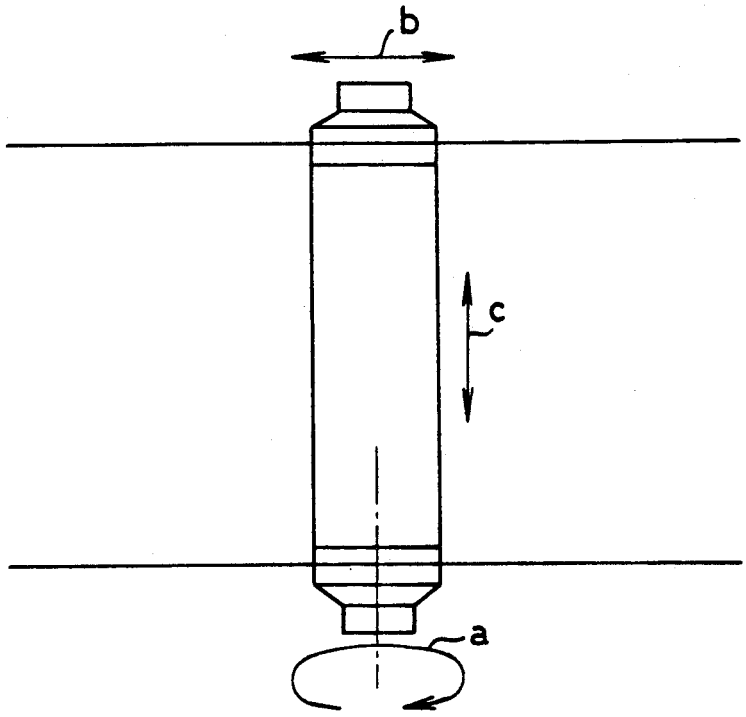
FIG. 5 gives an example of the pattern repeat setting possibilities of a stencil.

Alternatively, an operator can make the crosses 16 and 18 and 17 and 19 coincide by adjusting the lengthwise pattern repeat (rotation a, see FIG. 5), widthwise pattern repeat (translation c in the axial direction) and diagonal pattern repeat (translation of one side of the printing position, see b). If the two sides of the printing position are designed with sensors which record the movements which the operator has made, these recordings can be used directly to determine and save the printing position data.

In this way data can be generated once for all printing positions with printing position 7 as the reference printing position. These once determined printing position data have, as it were, become a fixed characteristic of the machine.

If a new set of patterned stencils is now placed in the printing positions, the stencil data alpha, beta and gamma of each stencil can be used to adapt the variables a, b, and c of each printing position in such a way that the entire machine prints in a regular pattern repeat.

It should be pointed out here that the position 7 used as the reference printing position in determining the printing position data will also be adjusted on the basis of the stencil data of the stencil which is used in the reference printing position 7.

It is, however, possible to fix printing position 7 if desired and to allow for the stencil data of the stencil in position 7 in the settings a, b and c of the other printing positions.

It goes without saying that the process described above for determining the stencil data and the printing position data must be seen as an example, and the design is not limited to the embodiment described here.

For example, the reference points can be in other forms and be fitted elsewhere on the end rings or stencils.

The angle position (a) of a stencil in a printing position can be measured by, for example, a sensor. This sensor can be a potentiometer fixed on the rotary drive means, so that a voltage taken off is a measure of the angular orientation of the stencil.

In the same way the positions c and b can be recorded by means of linear potentiometers and processed electronically. The printing position data can be stored in a memory file like the stencil data.

If a printing operation has to be carried out, the printing position pre-setting can be generated by combining the stencil data with the printing position data. The pre-setting can be presented in such a form that an operator can achieve the pre-setting by hand. It is also possible to achieve the pattern repeat setting possibilities a, b and c with servomotors combined with the sensors for a, b and c, all this controlled and monitored by a computer.

Figure 6:
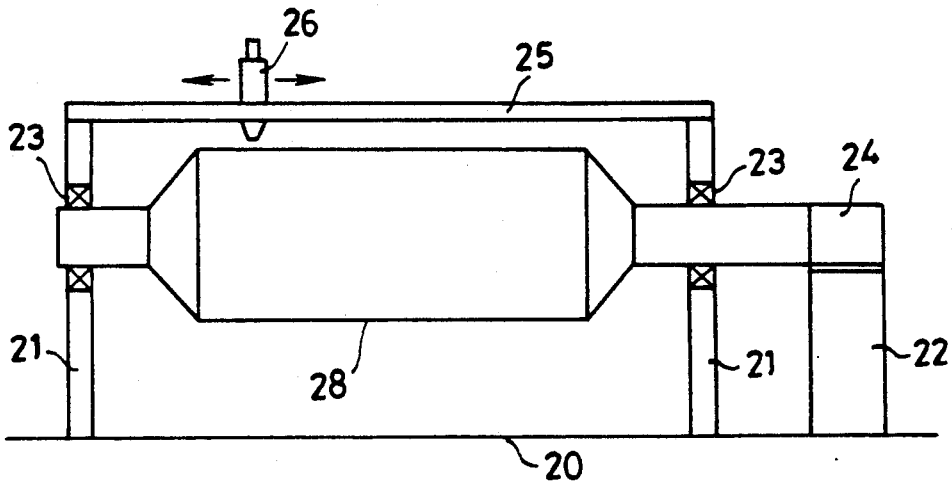
FIG. 6 shows a device for determining stencil data.

A device for determining the stencil data is shown schematically in FIG. 6.

The device comprises a frame 20 on which upright supports 21 and 22 are fitted. The supports 21 carry bearings 23 in which the stencil with end rings can be accommodated. The end ring on which the end ring reference point is provided is connected to an angle measuring device 24. This connection is such that on connecting of 23 to 24 the connection is well defined, in other words, the device 24 gives the orientation of the end ring a fixed known value, while the distance from 24 to a characteristic marking on the end ring is given a fixed known value.

The supports 21 also bear a measuring rod 25 along which a measuring microscope 26 can be slid.

By taking the stencil reference points 13 and 14 in the cross wires of the measuring microscope, in which case the measuring microscope must be slid along the measuring rod 25 and the stencil has to be rotated about its axis, the stencil parameters can be derived from the extent of the rotations and the distances along which the microscope has to be slid.

Figure 7:
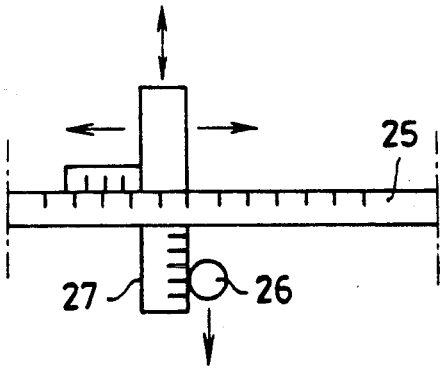
FIG. 7 shows schematically a device such as that in FIG. 6 for a stencil set up in a fixed manner.

These values can be read off visually; the angle measuring device and the measuring rod can also be provided with electronic measuring instruments, so that recording and processing by a processing unit is possible. Otherwise, in the event of the end ring reference point and the stencil reference points lying approximately in line with each other parallel to the stencil axis, the device can comprise a frame in which the stencil with end rings is clamped in a fixed orientation. The stencil data can then also be determined with a measuring microscope 26 which can be moved both along the measuring rod 25 and at right angles thereto along a second measuring rod (see FIG. 7).

What is claimed is:

1. A method for the pattern repeat presetting of a multi-printing position rotary screen printing machine for multi-colour printing, comprising the steps of: (a) providing patterned cylindrical stencils, each of said stencils comprising one or more stencil reference points related to the pattern; (b) providing an end ring at each end of each of said stencils, at least one of said end rings comprising an end ring reference point; (c) placing said stencils in the printing positions of the rotary screen printing machine; and (d) independently determining stencil data and printing position data, such that for each printing position a fixed relation between the stencil data and the printing position data is set.

2. A method according to claim 1, in which the stencil data are determined by measuring the relative positions between the end ring reference point and the stencil reference points.

3. A method according to claim 1, in which the printing position data of a nonreference printing position relative to a reference printing position are obtained by: (a) providing test stencils with associated end rings having known stencil data and reference points; (b) placing said test stencils in said reference printing position and in said nonreference printing position; (c) printing said reference points of said test stencils; and (d) measuring the deviance between said printed reference points of said test stencils.

4. A method according to claim 2, in which the printing position data of a nonreference printing position relative to a reference printing position are obtained by: (a) providing test stencils with associated end rings having known stencil data and reference points; (b) placing said test stencils in the reference printing position and in the nonreference printing position; (c) printing said reference points of said test stencils; and (d) measuring the deviance between said printed reference points of said test stencils.

5. A device for multi-colour rotary screen printing, comprising; (a) several means for accommodating patterned cylindrical stencils, each of said stencils comprising one or more stencil reference points related to the pattern and two end rings, at least one of said end rings comprising an end ring reference point; (b) means for setting the widthwise pattern repeat, lengthwise pattern repeat and the diagonal pattern repeat; and a computer having a memory file in which predetermined printing position and stencil data are accommodated, said computer generating the printing position setting data for the given stencil/printing position combination.

* * * * *

UNITED STATES PATENT AND TRADEMARK OFFICE

CERTIFICATE OF CORRECTION

PATENT NO. : 5,179,897

DATED : 19 January 1993

INVENTOR(S) : Paulus M. M. LIEBREGTS

It is certified that error appears in the above-identified patent and that said Letters Patent is hereby corrected as shown below:

| Column | Line | |
|---|---|---|
| 2 | 47 | Change "claim 4" to --claim 5--. |
| 2 | 49 | Change "4" to --5--. |

Signed and Sealed this

Twenty-second Day of February, 1994

*Attest:*

Bruce Lehman

BRUCE LEHMAN

*Attesting Officer*

*Commissioner of Patents and Trademarks*